US007686469B2

(12) United States Patent
Ruud et al.

(10) Patent No.: US 7,686,469 B2
(45) Date of Patent: Mar. 30, 2010

(54) LED LIGHTING FIXTURE

(75) Inventors: Alan J. Ruud, Racine, WI (US); Kurt Wilcox, Libertyville, IL (US); Steven R. Walczak, Kenosha, WI (US); Wayne Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 11/860,887

(22) Filed: Sep. 25, 2007

(65) Prior Publication Data

US 2008/0080196 A1 Apr. 3, 2008

Related U.S. Application Data

(63) Continuation-in-part of application No. 11/541,908, filed on Sep. 30, 2006, now abandoned.

(51) Int. Cl.
*F21V 29/00* (2006.01)

(52) U.S. Cl. ..... 362/101; 362/249.02; 362/373; 362/800; 362/294; 362/249.11

(58) Field of Classification Search ..... 362/800, 362/294, 373, 249.11, 249.02, 101
See application file for complete search history.

(56) References Cited

U.S. PATENT DOCUMENTS

| | | | |
|---|---|---|---|
| 2,772,382 | A | 11/1956 | Escoffery |
| 3,800,177 | A | 3/1974 | Russ |
| 3,819,929 | A | 6/1974 | Newman |
| 3,889,147 | A | 6/1975 | Groves |
| D246,203 | S | 10/1977 | Harris |
| 4,187,711 | A | 2/1980 | Lavochkin et al. |
| 4,203,488 | A | 5/1980 | Johnson et al. |
| 4,235,285 | A | 11/1980 | Johnson et al. |
| D266,080 | S | 9/1982 | Assanuma |
| D266,081 | S | 9/1982 | Assanuma |
| D266,082 | S | 9/1982 | Assanuma |
| D275,749 | S | 10/1984 | McCarthy |
| 4,508,163 | A | 4/1985 | McCarthy |
| 4,552,206 | A | 11/1985 | Johnson et al. |

(Continued)

FOREIGN PATENT DOCUMENTS

| | | |
|---|---|---|
| DE | 101 10 835 | 3/2001 |

(Continued)

OTHER PUBLICATIONS

Future Lighting Solutions brochure. "The 6 Steps to LED Lighting Success". 6 pages. Date: undated.

(Continued)

*Primary Examiner*—Anabel M Ton
(74) *Attorney, Agent, or Firm*—Jansson Shupe & Munger Ltd.

(57) ABSTRACT

An LED floodlight fixture including a housing that forms a substantially water/air-tight chamber, electronic LED driver (s) within the chamber, and an LED assembly secured with respect to the housing adjacent thereto in non-water/air-tight condition, the LED assembly having at least one LED-array module mounted on an LED heat sink. In certain preferred embodiments the housing is a perimetrical structure such that the substantially water-tight chamber substantially surrounds the LED assembly.

24 Claims, 15 Drawing Sheets

U.S. PATENT DOCUMENTS

D285,194 S 8/1986 McCarthy
4,679,118 A 7/1987 Johnson et al.
4,729,076 A 3/1988 Masami et al.
D296,778 S 7/1988 McCarthy
4,875,057 A 10/1989 Hediger et al.
4,899,210 A 2/1990 Lorenzetti et al.
5,119,174 A 6/1992 Chen
5,172,755 A 12/1992 Samarov
5,226,723 A 7/1993 Chen
D338,449 S 8/1993 Sahyoun
5,285,350 A 2/1994 Villaume
5,304,735 A 4/1994 Earl et al.
5,381,041 A 1/1995 Harmon
5,381,305 A 1/1995 Harmon et al.
5,384,940 A 1/1995 Soule et al.
5,436,798 A 7/1995 Wieland, Jr.
D361,317 S 8/1995 Harmon et al.
D361,986 S 9/1995 Harmon
5,494,098 A 2/1996 Morosas
5,562,146 A 10/1996 Harmon et al.
5,576,933 A 11/1996 Campanella et al.
D376,349 S 12/1996 Campanella et al.
5,581,442 A 12/1996 Morosas
5,611,393 A 3/1997 Vasconcelos et al.
5,632,551 A 5/1997 Roney et al.
5,660,461 A 8/1997 Ignatius et al.
D384,040 S 9/1997 Frerichs et al.
D390,539 S 2/1998 Campanella
D394,043 S 5/1998 Campanella et al.
5,771,155 A 6/1998 Cook
5,857,767 A 1/1999 Hochstein
D407,381 S 3/1999 Campanella
5,894,882 A 4/1999 Kikuchi et al.
5,936,353 A 8/1999 Triner et al.
6,011,299 A 1/2000 Brench
6,045,240 A 4/2000 Hochstein
D442,565 S 5/2001 Chou et al.
D442,566 S 5/2001 Chou et al.
6,229,160 B1 5/2001 Krames et al.
D445,922 S 7/2001 Yasuoka
6,255,786 B1 7/2001 Yen
6,274,924 B1 8/2001 Carey et al.
D450,306 S 11/2001 Lin et al.
6,323,063 B2 11/2001 Krames et al.
6,375,340 B1 4/2002 Biebl et al.
6,401,806 B1 6/2002 Lee et al.
6,428,189 B1 8/2002 Hochstein
6,449,151 B1 9/2002 Chen
6,457,837 B1 10/2002 Steffensmeier
D465,462 S 11/2002 Hsieh
6,481,874 B2 11/2002 Petroski
6,486,499 B1 11/2002 Krames et al.
6,498,355 B1 12/2002 Harrah et al.
6,501,103 B1 12/2002 Jory et al.
6,517,218 B2 2/2003 Hochstein
6,521,914 B2 2/2003 Krames et al.
6,547,249 B2 4/2003 Collins, III et al.
6,554,451 B1 4/2003 Keuper
6,558,021 B2 5/2003 Wu et al.
6,565,238 B1 5/2003 Pyrtle
6,570,190 B2 5/2003 Krames et al.
6,578,986 B2 6/2003 Swarls et al.
6,614,103 B1 9/2003 Durocher et al.
D481,017 S 10/2003 Hsia et al.
6,641,284 B2 11/2003 Stopa et al.
6,666,567 B1 12/2003 Feldman et al.
6,688,380 B2 2/2004 Lavochkin et al.
6,720,566 B2 4/2004 Blandford
D493,151 S 7/2004 Lee
D494,549 S 8/2004 Lee
6,815,724 B2 11/2004 Dry
6,834,981 B2 12/2004 Nagai et al.
6,851,831 B2 2/2005 Karlicek, Jr.
6,857,767 B2 2/2005 Matsui et al.
6,860,620 B2 3/2005 Kuan et al.
6,864,513 B2 3/2005 Lin et al.
6,885,035 B2 4/2005 Bhat et al.
6,914,261 B2 7/2005 Ho
6,932,495 B2 8/2005 Sloan et al.
6,934,153 B2 8/2005 Lee et al.
6,935,410 B2 8/2005 Lee et al.
6,999,318 B2 2/2006 Newby
7,008,080 B2 3/2006 Bachl et al.
7,045,965 B2 5/2006 Li et al.
7,055,987 B2 6/2006 Staufert
7,081,645 B2 7/2006 Chen et al.
D526,972 S 8/2006 Egawa et al.
7,178,941 B2 2/2007 Roberge et al.
7,234,844 B2 6/2007 Bolta et al.
D551,379 S 9/2007 Maxik
7,267,459 B2 * 9/2007 Matheson ..... 362/362
7,278,761 B2 * 10/2007 Kuan ..... 362/294
7,488,090 B1 * 2/2009 Bucher et al. ..... 362/267
7,534,009 B2 * 5/2009 Trojanowski et al. ..... 362/234
7,549,774 B2 * 6/2009 Tsai ..... 362/294
7,566,147 B2 * 7/2009 Wilcox et al. ..... 362/240
2002/0070386 A1 6/2002 Krames et al.
2002/0171087 A1 11/2002 Krames et al.
2003/0189829 A1 10/2003 Shimizu et al.
2004/0052077 A1 3/2004 Shih
2004/0161338 A1 8/2004 Hsieh
2004/0174651 A1 9/2004 Aisenbrey
2004/0175189 A1 9/2004 Weber-Rabsilber et al.
2004/0212291 A1 10/2004 Keuper
2004/0213016 A1 10/2004 Rice
2004/0222516 A1 11/2004 Lin et al.
2004/0257006 A1 12/2004 Beeman et al.
2004/0257808 A1 12/2004 Bjornson et al.
2004/0264195 A1 12/2004 Chang et al.
2005/0023545 A1 2/2005 Camras et al.
2005/0052378 A1 3/2005 Hacker
2005/0057939 A1 3/2005 Mizuyoshi
2005/0072558 A1 4/2005 Whitney et al.
2005/0135093 A1 6/2005 Alexanderson et al.
2005/0190562 A1 9/2005 Keuper et al.
2005/0224826 A1 10/2005 Keuper et al.
2005/0274959 A1 12/2005 Kim et al.
2005/0281033 A1 12/2005 Coushaine et al.
2006/0018099 A1 1/2006 Chen
2006/0061967 A1 3/2006 Kim et al.
2006/0097385 A1 5/2006 Negley
2006/0105482 A1 5/2006 Alferink et al.
2006/0131757 A1 6/2006 Yu et al.
2006/0138645 A1 6/2006 Ng et al.
2006/0138951 A1 6/2006 Tain et al.
2006/0141851 A1 6/2006 Matsui et al.
2006/0181878 A1 8/2006 Burkholder
2008/0037239 A1 2/2008 Thomas et al.
2008/0080162 A1 * 4/2008 Wilcox et al. ..... 362/20
2008/0080189 A1 4/2008 Wang

FOREIGN PATENT DOCUMENTS

EP 1 143 653 6/2004
EP 1 431 653 6/2004
JP 2005-109228 4/2001
JP 2007-134190 5/2007
NL 1026514 6/2004
WO WO 98/33007 7/1998
WO WO98/33007 7/1998
WO WO 99/57945 11/1999
WO WO99/57945 11/1999
WO WO 02/16826 2/2002
WO WO 03/089841 10/2003

| | | |
|---|---|---|
| WO | WO2004/079256 | 9/2004 |
| WO | WO2006/049086 | 5/2006 |
| WO | WO2006/060905 | 6/2006 |
| WO | WO 2006/060905 | 6/2006 |

OTHER PUBLICATIONS

Excerpt from Aavid Thermalloy (www.aavidthermalloy.com). "LED Light Sources". 1 page. Date: Copyright 2006.

Aavid Thermal Technologies, Inc. article. "How to Select a Heat sinck". 5 pages. Date: undated.

Excerpt from Mouser Electronics (www.mouser.com). Product List. 1 page. Date: Aug. 16, 2006.

Excerpt from Lumileds Future Electronics (www.lumiledsfuture.com). "Thermal Solutions". 1 page. Date: Jul. 14, 2006.

Excerpt from National Northeast Corporation brochure. "Miscellaneous Shape Heat Sinks". 2 pages. Date: undated.

Excerpt from Aavid Thermalloy (www.aavidthermalloy.com). Part Specification. 3 pages. Date: Copyright 2006.

Excerpt from Aavid Thermalloy (www.aavidthermalloy.com). Part Specification. 1 page. Date: Copyright 2006.

Excerpt from Therma-Flo brochure. 8 pages. Date: Copyright 2002.

Excerpt from Aavid Thermalloy (www.aavidthermalloy.com). "Product Offerings". 2 pages. Date: Copyright 2006.

Excerpt from ThermaFlo (www.thermaflo.com). "Bonded Fin Heat Sinks". 1 page. Date: Aug. 24, 2006.

Excerpt from ThermaFlo (www.thermaflo.com). "Folded Fin Heat Sinks". 2 pages. Date: Aug. 24, 2006.

Excerpt from ThermaFlo (www.thermaflo.com). "High Power Heat Sinks". 2 pages. Date: Aug. 24, 2006.

National Northwest Corporation brochure. "Flat Back Shape Heat Sinks III". 12 pages. Date: undated.

Excerpt from Wakefield Thermal Solutions (www.wakefield.com). "Thermal Extrusions". 1 page. Date: Aug. 16, 2006.

Wakefield Thermal Solutions brochure. "Quality Aluminum Extrusion and Fabrication". 4 pages. Date: undated.

Stanley Electric Co., Ltd. "Stanely LED for Street Lgiht Brochure." Date: Aug. 2006.

* cited by examiner

LED LIGHTING FIXTURE

RELATED APPLICATION

This application is a continuation-in-part of patent application Ser. No. 11/541,908, filed Sep. 30, 2006, currently pending. The contents of the parent application are incorporated herein by reference.

FIELD OF THE INVENTION

This invention relates to lighting fixtures and, more particularly, to floodlight fixtures using LED modules.

BACKGROUND OF THE INVENTION

In recent years, the use of light-emitting diodes (LEDs) for various common lighting purposes has increased, and this trend has accelerated as advances have been made in LEDs and in LED arrays, often referred to as "LED modules." Indeed, lighting applications which previously had been served by fixtures using what are known as high-intensity discharge (HID) lamps are now beginning to be served by fixtures using LED-array-bearing modules. Such lighting applications include, among a good many others, roadway lighting, factory lighting, parking lot lighting, and commercial building lighting.

Floodlights using LED modules as light source for various applications present particularly challenging problems in fixture development, particularly when floodlight mounting locations and structures will vary. Among other things, placement of the electronic LED power units (LED drivers) for lighting fixtures using LED arrays can be particularly problematic. In some cases, keeping such electronic LED drivers in a water/air-tight location may not be difficult, but if mounting locations and structures vary, then location and protection of such components becomes difficult and adds development costs and potential problems. Lighting-fixture adaptability is an important goal for LED floodlights that are often presented and mounted in different ways.

Heat dissipation is another problem for LED floodlights. And, the goals of dealing with heat dissipation and protection of electronic LED drivers can often be conflicting, contrary goals.

In short, there is a significant need in the lighting industry for improved floodlight fixtures using modular LED units—fixtures that are adaptable for a wide variety of mountings and situations, and that satisfy the problems associated with heat dissipation and appropriate protection of electronic LED driver components. Finally, there is a need for an improved LED-module-based floodlight which is easy and inexpensive to manufacture.

OBJECTS OF THE INVENTION

It is an object of the invention to provide an improved LED floodlight fixture that overcomes some of the problems and shortcomings of the prior art, including those referred to above.

Another object of the invention is to provide an improved LED floodlight fixture that is readily adaptable for a variety of mounting positions and situations.

Another object of the invention is to provide an improved LED floodlight that reduces development and manufacturing costs for LED floodlight for different floodlight applications.

Another object of the invention is to provide an improved LED floodlight with excellent protection of the electronic LED drivers needed for such products.

Still another object of the invention is to provide an improved LED floodlight with both good protection of electronic LED drivers and excellent heat dissipation.

How these and other objects are accomplished will become apparent from the following descriptions and the drawings.

SUMMARY OF THE INVENTION

The present invention is an improvement in LED floodlight fixtures. The inventive LED floodlight fixture includes a housing forming a substantially water/air-tight chamber, at least one electronic LED driver enclosed within the chamber, and an LED assembly secured with respect to the housing adjacent thereto in non-water/air-tight condition, the LED assembly having at least one LED-array module mounted on an LED heat sink.

The housing preferably includes substantially water/air-tight wire-access(es) for passage of wires between the LED assembly and the water/air-tight chamber.

The housing includes a first border structure forming a first border-portion of the chamber, the first border structure receiving wires from the at least one LED-array module and the LED heat sink being interlocked with the first border structure. The housing further includes a frame structure forming a frame-portion of the chamber secured to the first border structure, the frame structure extending along the LED assembly. It is highly preferred that the border structure is a metal extrusion.

In some preferred embodiments, the first border structure has at least one bolt-receiving border-hole through the first border structure, such border-hole being isolated from the first border-portion of the chamber. The frame structure also has at least one bolt-receiving frame-hole through the frame structure, the frame-hole being isolated from the frame-portion of the chamber. Each such one or more frame-holes are aligned with a respective border-hole(s). A bolt passes through each aligned pair of bolt-receiving holes such that the border structures and the frame structure are bolted together while maintaining the water/air-tight condition of the chamber.

In some highly preferred embodiments, the housing includes a second border structure forming a second border-portion of the chamber, the LED heat sink being interlocked with the second border structure. In such embodiments, the frame structure is secured to the first and second border structures.

The frame structure preferably includes an opening edge about the frame-portion of the chamber. A removable cover-plate is preferably in substantial water/air-tight sealing engagement with respect to the opening edge. Such opening edge may also have a groove configured for mating water/air-tight engagement with the border structure(s). It is preferred that one or more electronic LED drivers are enclosed in the frame-portion of the chamber.

In certain preferred embodiments the frame structure preferably includes a vent permitting air flow to and from the LED assembly. Such venting facilitates cooling the LED assembly.

In certain highly preferred embodiments of this invention, including those used for street lighting and the like, the housing is a perimetrical structure such that the substantially water/air-tight chamber substantially surrounds the LED assembly. The perimetrical structure is preferably substantially rectangular and includes the first and second border structures and a pair of opposed frame structures each secured to the first and second border structures.

In some versions of the inventive LED floodlight fixture, the housing is a perimetrical structure configured for wall mounting and includes the first and second border structures on opposed perimetrical sides and the frame structure secured on a perimetrical side between the border structures.

In such embodiments, each of the first and second border structures preferably has at least one bolt-receiving border-hole therethrough isolated from the first and second border-portion of the chamber, respectively. Each of the frame structures has at least one bolt-receiving frame-hole therethrough isolated from the frame-portion of the chamber, each such frame-holes aligned with respective border-holes of each of the border structures. A bolt is passing through each aligned set of bolt-receiving holes such that the border structures and the frame structures are bolted together while maintaining the water/air-tight condition of the chamber.

In certain highly preferred embodiments of the inventive LED floodlight fixture, the LED assembly includes a plurality of LED-array modules each separately mounted on its corresponding LED heat sink, the LED heat sinks being interconnected to hold the LED-array modules in fixed relative positions. Each heat sink preferably includes a base with a back base-surface, an opposite base-surface, two base-ends and first and second base-sides, a female side-fin and a male side-fin, one along each of the opposite sides and each protruding from the opposite surface to terminate at a distal fin-edge. The female side-fin includes a flange hook positioned to engage the distal fin-edge of the male side-fin of an adjacent heat sink. At least one inner-fin projects from the opposite surface between the side-fins. One of the LED modules is against the back surface.

In some preferred embodiments, each heat sink includes a plurality of inner-fins protruding from the opposite base-surface. Each heat sink may also include first and second lateral supports protruding from the back base-surface, the lateral supports each having an inner portion and an outer portion, the inner portions of the first and second lateral supports having first and second opposed support-ledges, respectively, forming a heat-sink-passageway slidably supporting one of the LED-array modules against the back base-surface. The first and second supports of each heat sink are preferably in substantially planar alignment with the first and second side-fins, respectively. The flange hook is preferably at the distal fin-edge of the first side-fin.

It is highly preferred that each heat sink be a metal extrusion with the back base-surface of such heat sink being substantially flat to facilitate heat transfer from the LED-array module, which itself has a flat surface against the back-base surface.

Each heat sink also preferably includes a lateral recess at the first base-side and a lateral protrusion at the second base-side, the recesses and protrusions being positioned and configured for mating engagement of the protrusion of one heat sink with the recess of the adjacent heat sink.

In certain of the above preferred embodiments, the female and male side-fins are each a continuous wall extending along the first and second base-sides, respectively. It is further preferred that the inner-fins are also each a continuous wall extending along the base. The inner-fins can be substantially parallel to the side-fins.

In highly preferred embodiments, the LED floodlight fixture further includes an interlock of the housing to the LED assembly. The interlock has a slotted cavity extending along the housing and a cavity-engaging coupler which extends from the heat sink of the LED assembly and is received within the slotted cavity.

In some of such preferred embodiments, in each heat sink, at least one of the inner-fins is a middle-fin including a fin-end forming a mounting hole receiving a coupler. In some versions of such embodiments, the coupler has a coupler-head; and the interlock is a slotted cavity engaging the coupler-head within the slotted cavity. The slotted cavity preferably extends along the border structure and the coupler-head extends from the heat sink of the LED assembly.

In preferred embodiments of this invention, the LED floodlight fixture includes a restraining bracket secured to the housing. The bracket has a plurality of projections extending between adjacent pairs of fins of the heat sink, thus to secure the LED assembly. The restraining bracket preferably has a comb-like structure including an elongated body with a spine-portion from which identical side-by-side projections extend in a common plane. Such restraining bracket is configured and dimensioned for the elongated body to be fixedly secured to the housing and the projections to snugly fit in spaces between adjacent heat-sink fins, thus holding heat sink from moving.

The LED floodlight fixture further includes a mounting assembly secured to the housing. The mounting assembly preferably has a pole-attachment portion and a substantially water/air-tight section enclosing electrical connections with at least one wire-aperture communicating with the water/air-tight chamber. The housing is in water/air-tight engagement with the water/air-tight section of the pole-mounting assembly.

In the aforementioned substantially rectangular versions of this invention, in which the perimetrical structure includes a pair of opposed frame structures and a first and second opposed border structures, the second border structure may have two sub-portions with a gap therebetween. The sub-portions each include all of the border-structure elements.

In the mounting assembly of such embodiments, the pole-attachment portion preferably receives and secures a pole. Each wire-aperture communicates with the border-portion chamber of a respective one of the second border-structure sub-portions. The gap between the second border-structure sub-portions accommodates the pole-mounting assembly secured to the LED assembly between the border sub-portions. The second border-structure sub-portion(s) are in water/air-tight engagement with the water/air-tight section of the pole-mounting assembly. The pole-attachment portion preferably includes grooves on its opposite sides, the grooves being configured for mating engagement with end edges of the border-structure sub-portions.

Preferably, the pole-mounting assembly has a mounting plate abutting the LED assembly, and at least one fastener/coupler extends from the mounting plate for engagement with the mounting hole of the middle-fin(s).

In some LED floodlight fixtures of this invention, the frame-portion of the chamber has a chamber-divider across the chamber, such chamber-divider having a divider-edge. The chamber-divider divides the frame-portion of the chamber into an end part and a main part that encloses the electronic LED driver(s). The chamber-divider preferably includes a substantially water/air-tight wire-passage therethrough. The wire-passage is preferably a notch having spaced notch-wall ends that terminate at the divider-edge. A notch-bridge spans the notch to maintain the water/air-tight condition of the chamber. The notch-bridge preferably includes a bridge-portion and a pair of gripping-portions configured for spring-grip attachment to the notch-wall ends.

Preferably, the removable cover-plate seals the main part of the frame-portion of the chamber in substantially water/air-tight condition.

In certain embodiments of this invention, including those used for parking-structure lighting and the like, the frame structure is a sole frame structure, and the housing is a substantially H-shaped structure with the sole frame structure secured between mid-length positions of the pair of opposed border structures.

Some of the inventive LED floodlight fixtures include a protective cover extending over the LED assembly and secured with respect to the housing. Such protective cover preferably has perforations permitting air/water-flow therethrough for access to and from the LED assembly.

It is most highly preferred that the LED floodlight fixture has a venting gap between the housing and the LED assembly to permit water/air-flow from the heat sink. The venting gap may be formed by the interlock of the housing to the LED assembly.

The improved LED floodlight fixture of this invention overcomes the problems discussed above. Among other things, the invention provides substantially water/air-tight enclosure of electronic LED drivers inside the fixture, while still accommodating heat-dissipation requirements. And, the fixture of this invention is both adaptable for varying applications and mountings, and relatively inexpensive to manufacture.

The term "perimetrical structure" as used herein means an outer portion of the fixture which completely or partially surrounds remaining portions of the fixture. In certain preferred embodiments, such as those most useful for road-way lighting and the like, the perimetrical structure preferably completely surrounds remaining portions of the fixture. In certain other cases, such as certain wall-mounted floodlight fixtures, the perimetrical structure partially surrounds the remaining portions of the fixture.

DETAILED DESCRIPTION OF PREFERRED EMBODIMENTS

Figure 1:
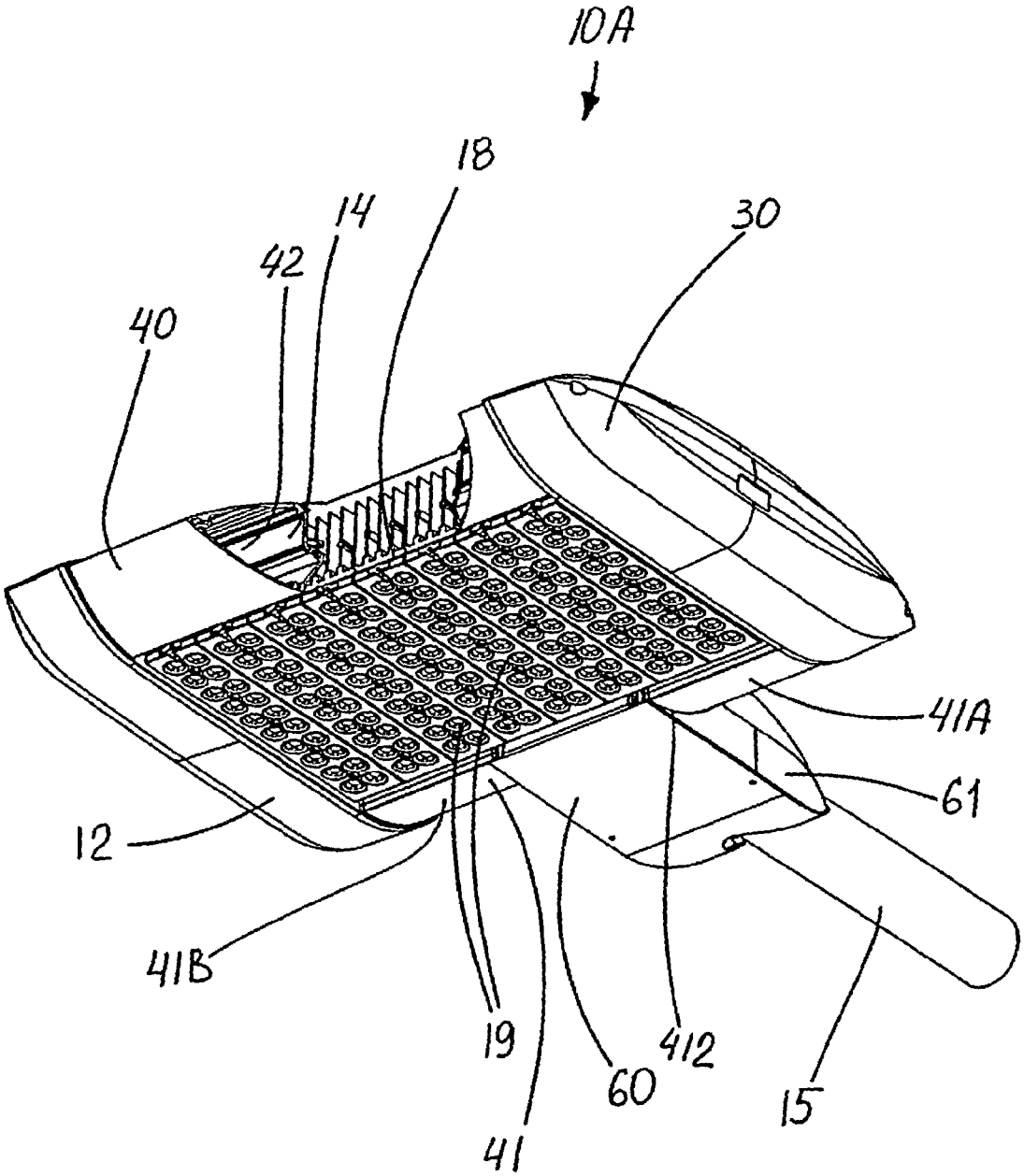
FIG. 1 is a perspective view of a preferred LED floodlight fixture in accordance with this invention, including a cut-away portion showing an LED assembly.

FIGS. 1-15 illustrate preferred LED floodlight fixtures 10A-10D in accordance with this invention. Common or similar parts are given the same numbers in the drawings of both embodiments, and the floodlight fixtures are often referred to by the numeral 10, without the A or D lettering used in the drawings, and in the singular for convenience.

Floodlight fixture 10 includes a housing 12 that forms a substantially water/air-tight chamber 14, at least one electronic LED driver 16 which is enclosed within chamber 14, and an LED assembly 18 that is secured with respect to housing 12 adjacent thereto in non-water/air-tight condition. LED assembly 18 has a plurality of LED-array modules 19 each secured to an LED heat sink 20.

Figure 7:
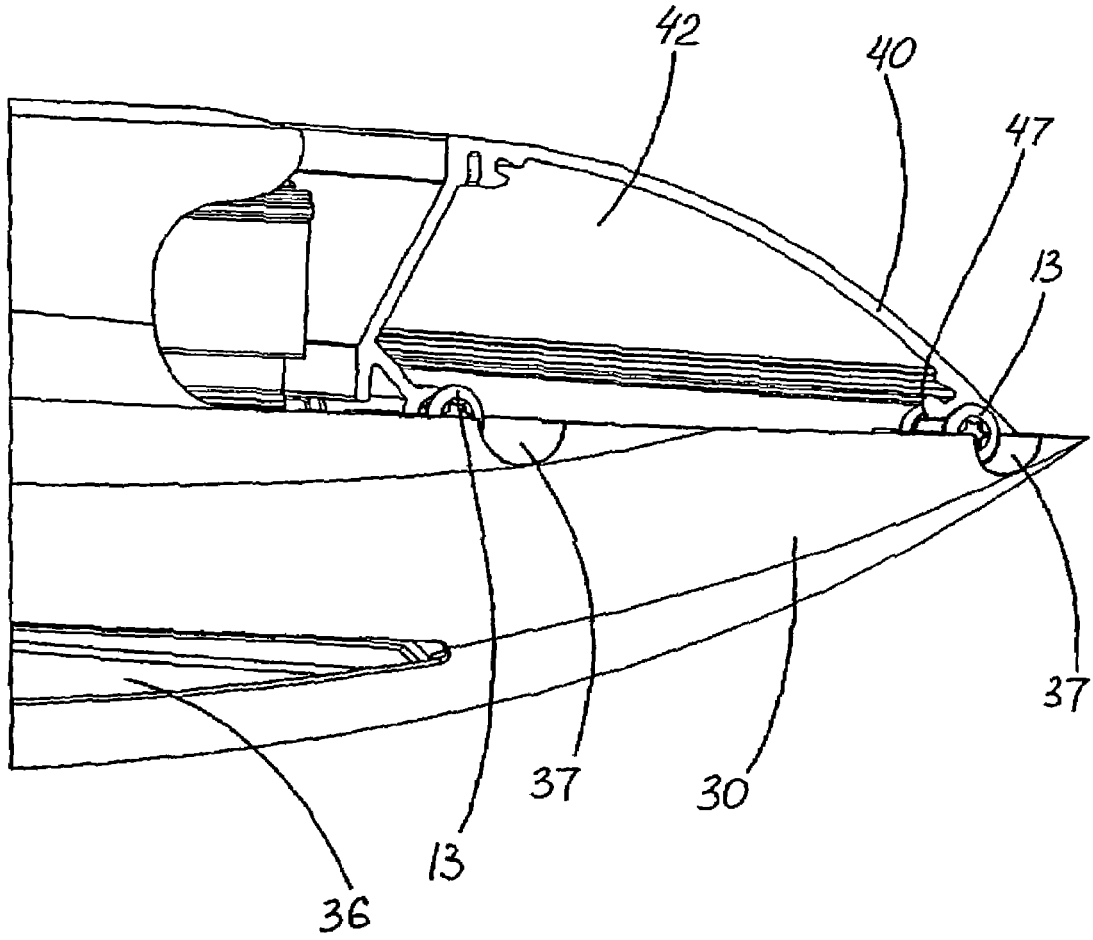
FIG. 7 is another fragmentary perspective view showing the frame structure partially cut-away view to illustrate its being bolted together with the border structure.
Figure 8:
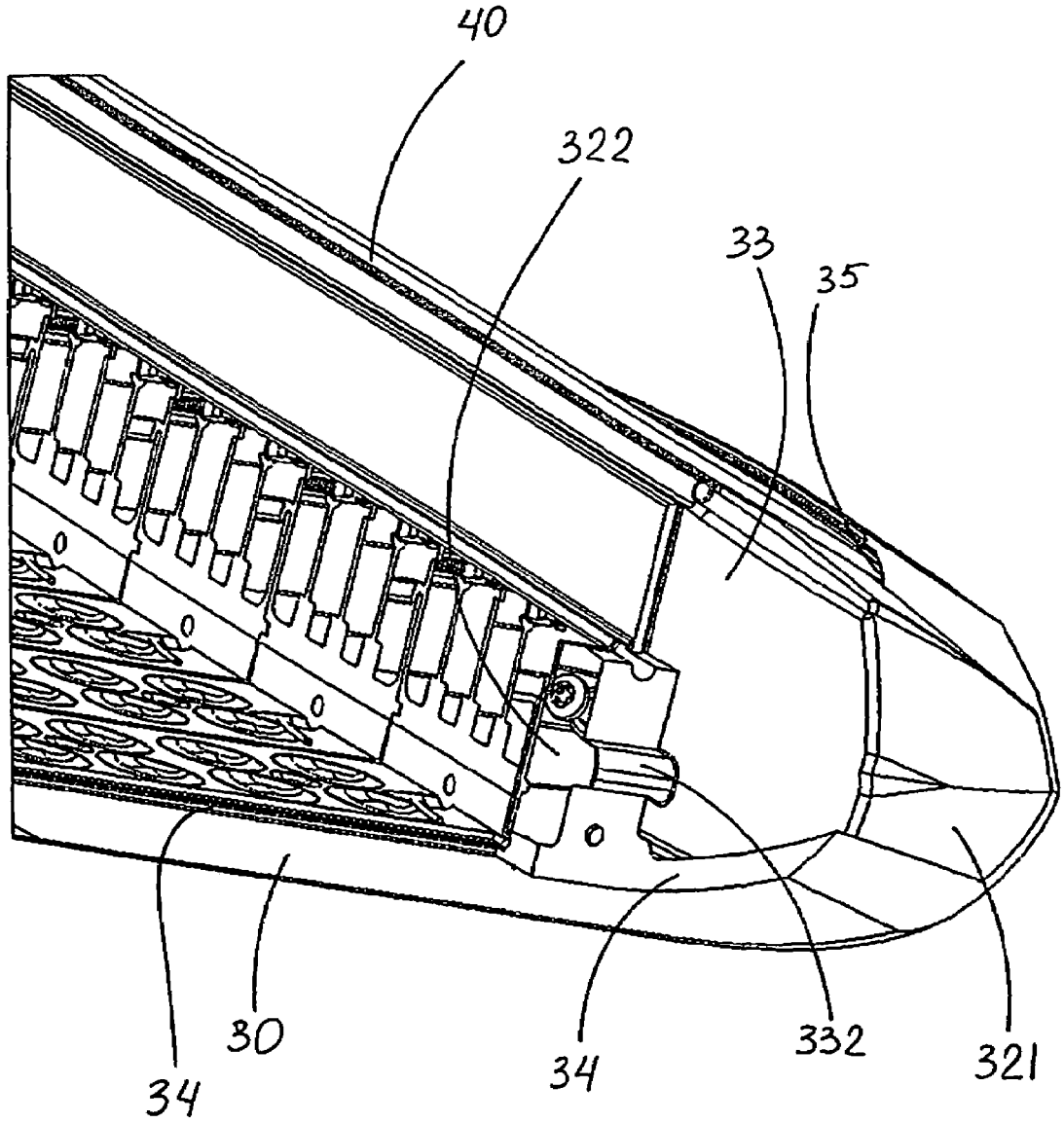
FIG. 8 is another fragmentary perspective view showing the border structure partially cut-away view to illustrates its engagement with the frame structure.

As seen in FIGS. 1-4, 7 and 8, housing 12 includes a frame structure 30 forming a frame-portion 32 of chamber 14 with an opening edge 34 thereabout and a border structure 40 (sometimes referred to as a nose structure 40) secured to frame structure 30 and forming a border-portion 42 (sometimes referred to as nose-portion 42) of chamber 14. As best seen in FIG. 8, opening edge 34 of frame-portion 30 of chamber 14 includes a groove 35 configured for mating water/air-tight engagement with border structure 40. Border structure 40 is an extrusion, preferably of aluminum. FIG. 5 shows electronic LED drivers 16 enclosed in frame-portion 32 of chamber 14.

Figure 6:
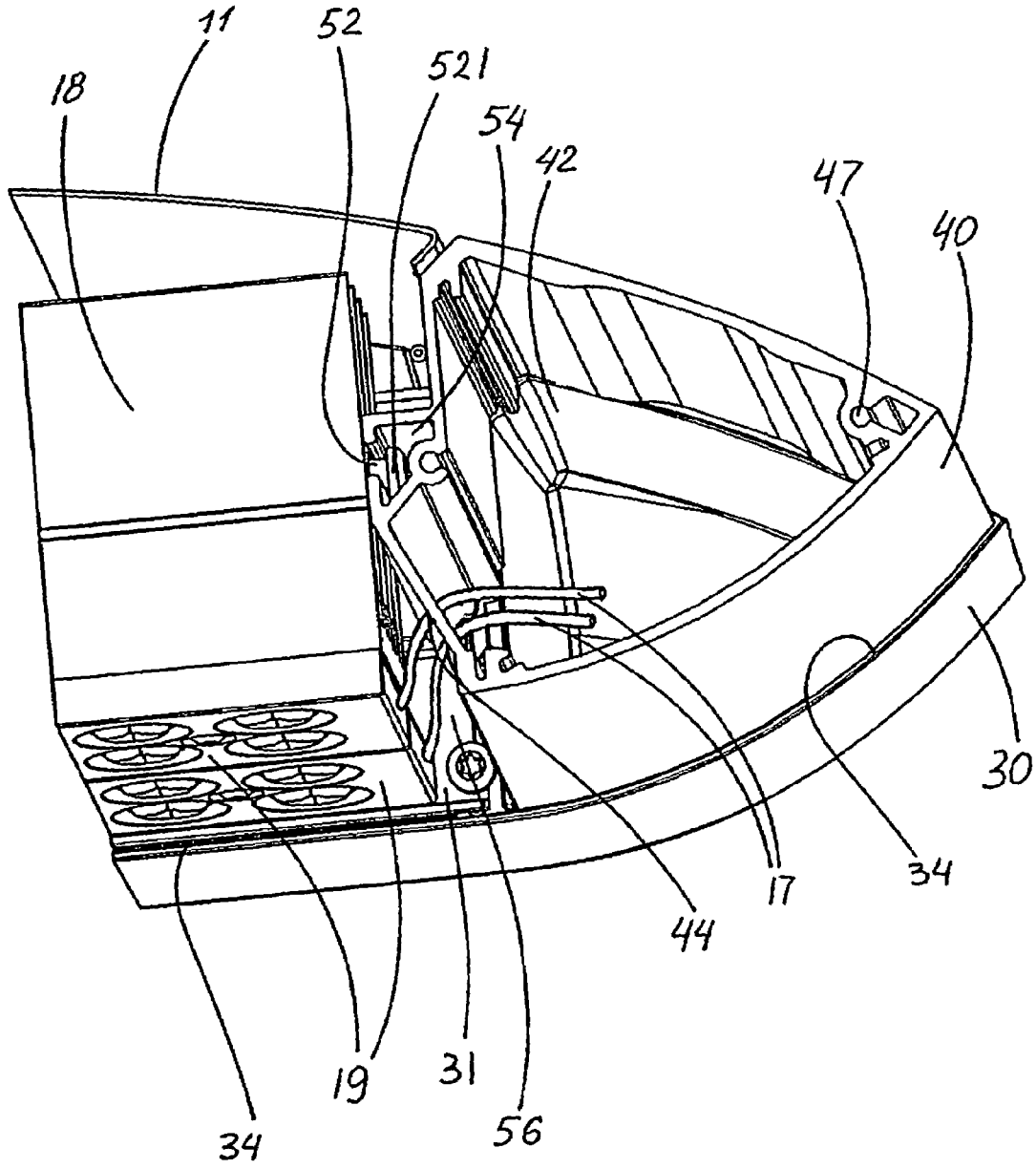
FIG. 6 is an enlarged fragmentary view of the right portion of FIG. 4.

As best seen in FIG. 6, border structure 40 includes substantially water/air-tight wire-accesses 44 for passage of wires 17 between LED assembly 18 and water/air-tight chamber 14.

FIGS. 2, 3, 5 and 7 show that frame structure 30 includes a vent 36 permitting air flow to and from LED assembly 18. Vent 36 facilitates cooling of LED assembly 18.

As best illustrated in FIGS. 6 and 7, border structure 40 has bolt-receiving border-hole 47 therethrough which is isolated from border-portion 42 of chamber 14. And, frame structure 30 has bolt-receiving frame-holes 37 therethrough which are isolated from frame-portion 32 of chamber 14; frame-hole 37 is aligned with a respective border-hole 47. A bolt 13 passes through aligned pair of bolt-receiving holes 37 and 47 such that border structure 40 and frame structure 30 are bolted together while maintaining the water/air-tight condition of chamber 14.

Figure 3:
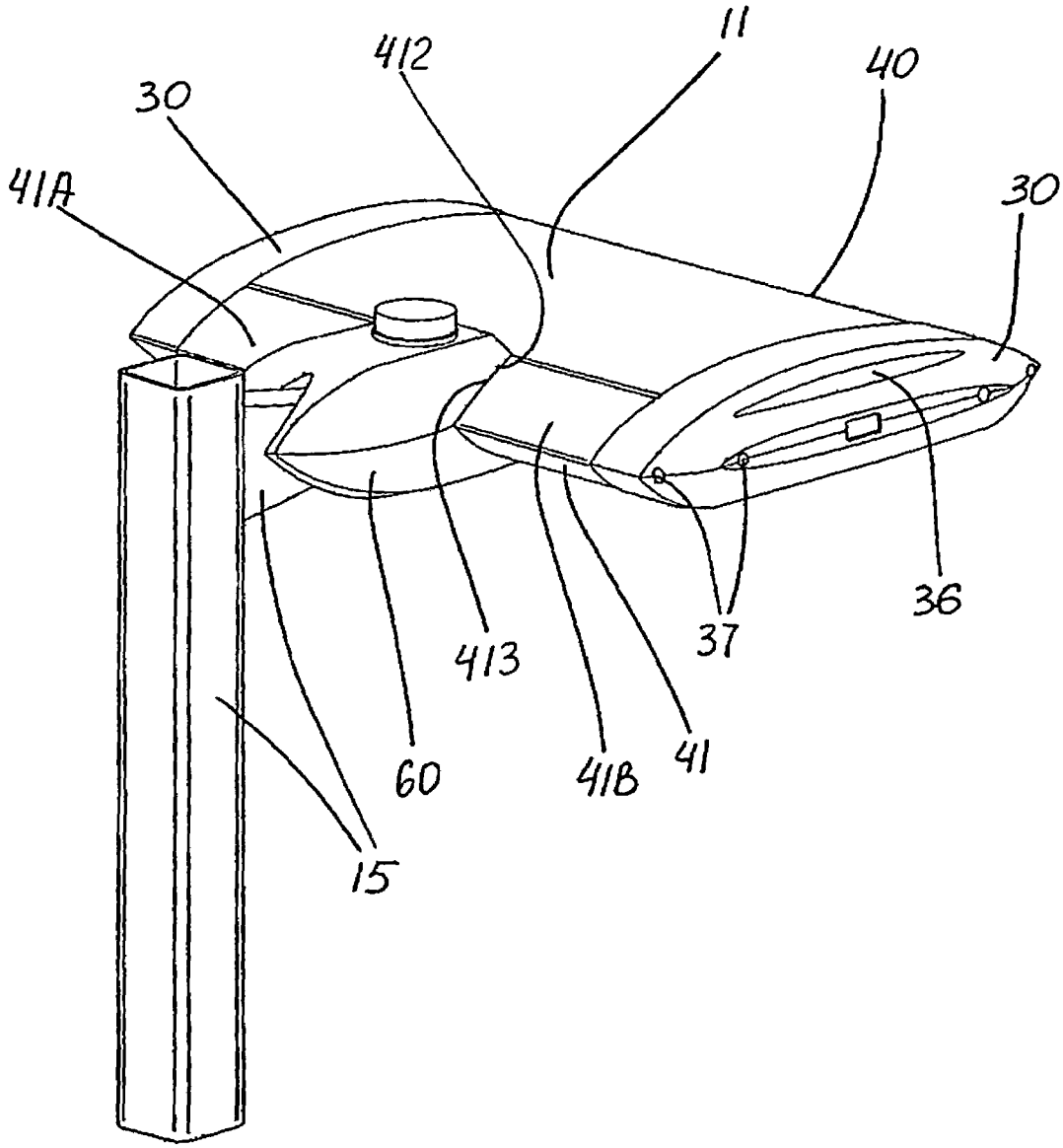
FIG. 3 is a perspective view of another LED floodlight fixture including a pole-mounting assembly on a pole of square cross-section.

FIGS. 1 and 3 best illustrate certain highly preferred embodiments of this invention in which housing 12 is a perimetrical structure which includes a pair of opposed frame structures 30 and a pair of opposed nose structures 40, making perimetrical structure 12 of floodlight fixture 10A substantially rectangular. FIGS. 1, 4-8 and 11 illustrate aspects of inventive LED floodlight fixture 10A.

Figure 10:
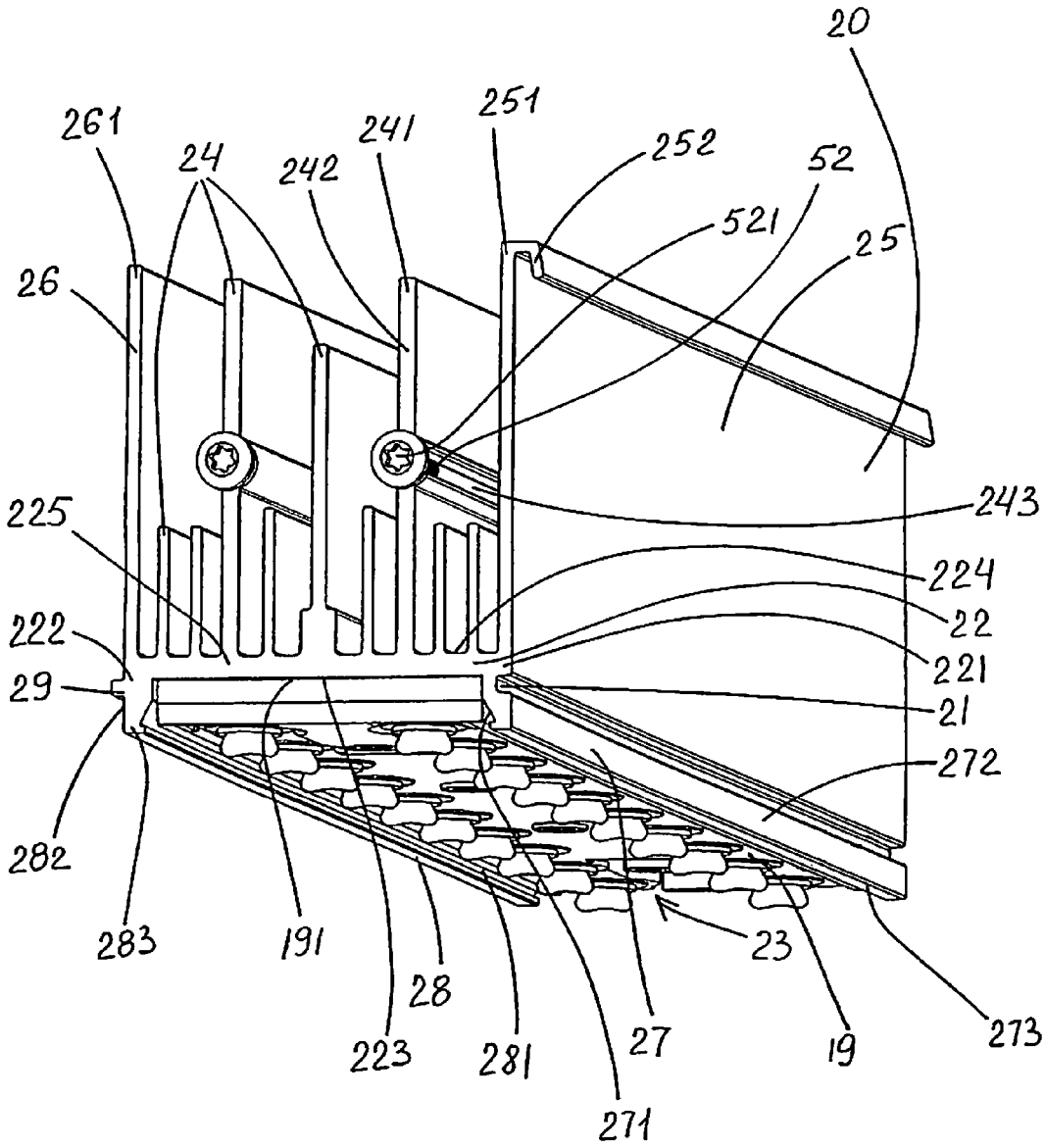
FIG. 10 is an enlarged fragmentary perspective view of one LED-array module LED and its related LED heat sink of the LED assembly of the illustrated LED floodlight fixtures.
Figure 11:
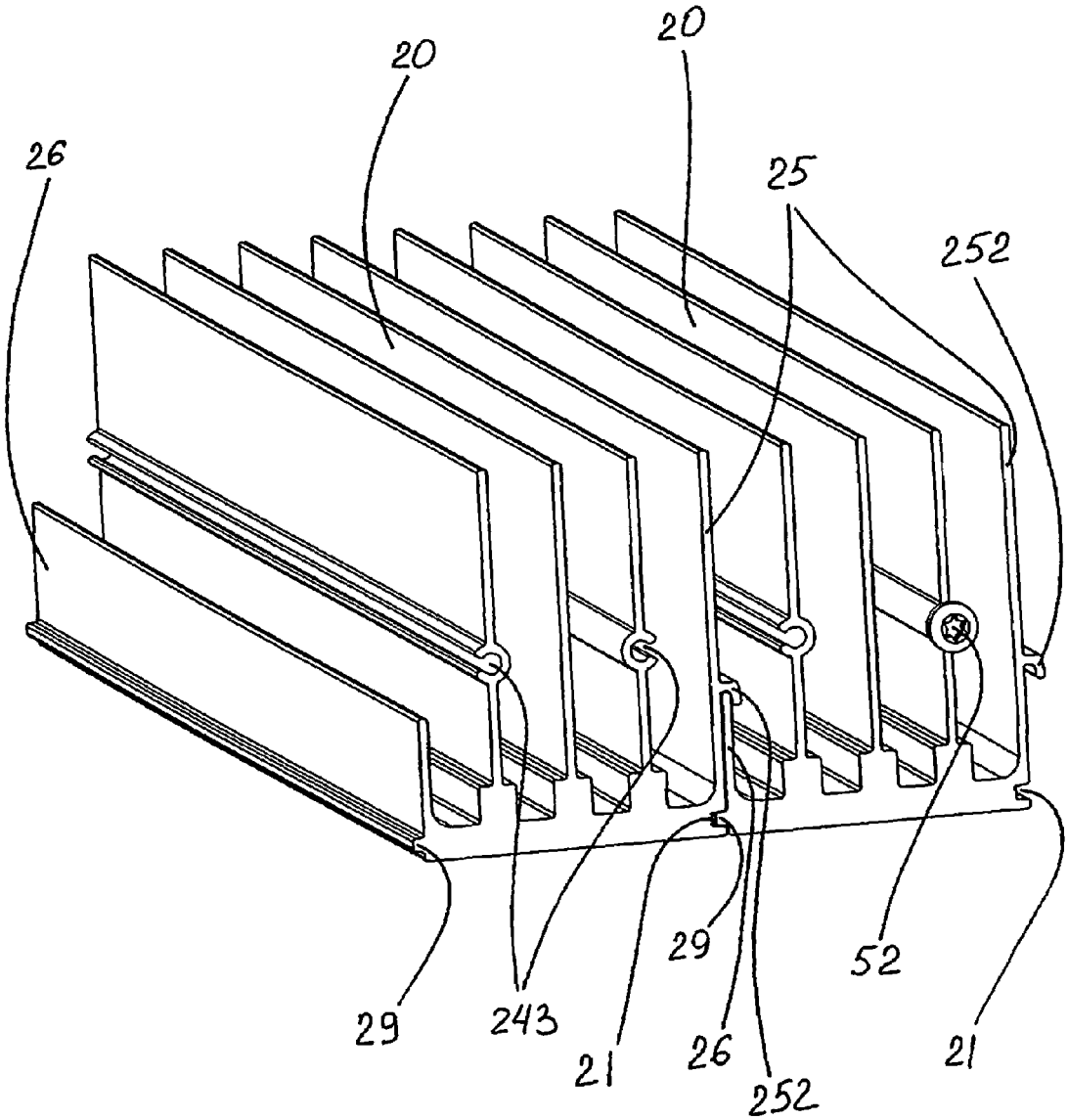
FIG. 11 is an enlarged fragmentary end-wise perspective view of two interconnected LED heat sinks of the LED assembly of the illustrated LED floodlight fixtures.

In LED floodlight fixtures 10, LED assembly 18 includes a plurality of LED-array modules 19 each separately mounted on its corresponding LED heat sink 20, such LED heat sinks 20 being interconnected to hold LED-array modules 19 in fixed relative positions. Each heat sink 20 includes: a base 22 with a back base-surface 223, an opposite base-surface 224, two base-ends 225 and first and second base-sides 221 and 222; a plurality of inner-fins 24 protruding from opposite base-surface 224; first and second side-fins 25 and 26 protruding from opposite base-surface 224 and terminating at distal fin-edges 251 and 261, first side-fin 25 including a flange hook 252 positioned to engage distal fin-edge 261 of second side-fin 26 of adjacent heat sink 20; and first and second lateral supports 27 and 28 protruding from back base-surface 223, lateral supports 27 and 28 each having inner portions 271 and 281, respectively, and outer portion 272 and 282, respectively. Inner portions 271 and 281 of first and second lateral supports 27 and 28 have first and second opposed support-ledges 273 and 283, respectively, that form a heat-sink-passageway 23 which slidably supports an LED-array module 19 against back base-surface 223. First and second supports 27 and 28 of each heat sink 20 are in substantially planar alignment with first and second side-fins 25 and 26, respectively. As seen in FIGS. 10 and 11, the flange hook is at 251 distal fin-edge of first side-fin 25.

Each heat sink 20 is a metal (preferably aluminum) extrusion with back base-surface 223 of heat sink 20 being substantially flat to facilitate heat transfer from LED-array module 19, which itself has a flat surface 191 against back-base surface 223. Each heat sink 20 also includes a lateral recess 21 at first base-side 221 and a lateral protrusion 29 at second base-side 222, recesses 21 and protrusions 29 being positioned and configured for mating engagement of protrusion 29 of one heat sink 20 with recess 21 of adjacent heat sink 20.

As best seen in FIGS. 1, 4, 5, 6, 10 and 11, first and second side-fins 25 and 26 are each a continuous wall extending along first and second base-sides 221 and 222, respectively. Inner-fins 24 are also each a continuous wall extending along base 22. Inner-fins 24 are substantially parallel to side-fins 25 and 26.

Figure 4:
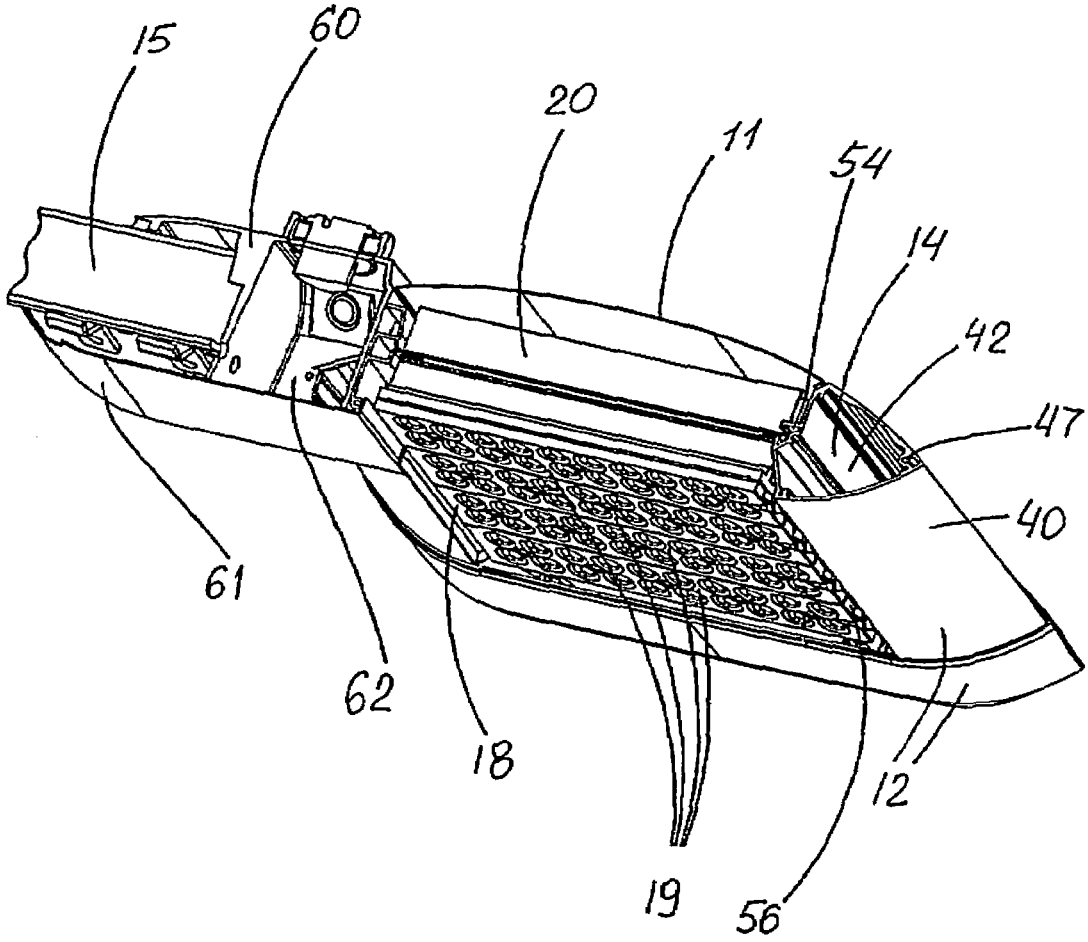
FIG. 4 is a side perspective view of the LED floodlight of FIG. 1 broken away at a middle portion to show interior structure.
Figure 5:
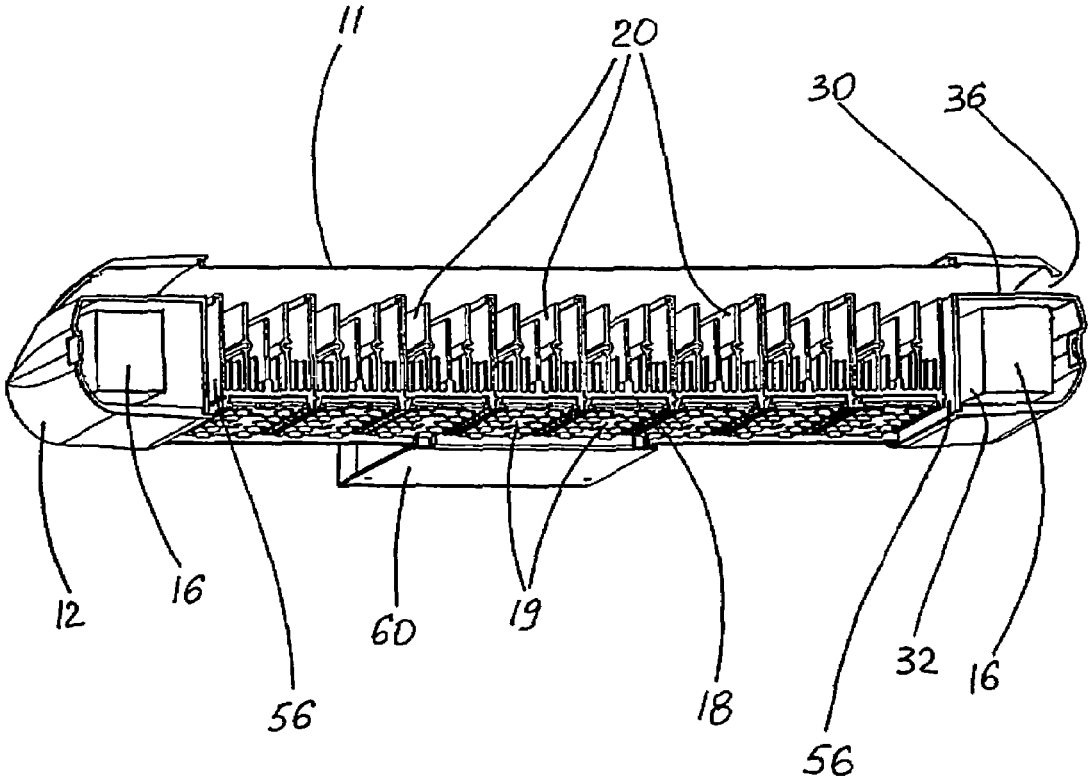
FIG. 5 is a front perspective view of the LED floodlight of FIG. 1 broken away at a middle portion to show interior structure.

FIGS. 4 and 6 show an interlock of housing 12 to LED assembly 18. As best seen in FIGS. 10 and 11, in each heat sink 20 inner-fins 24 include two middle-fins 241 each of which includes a fin-end 242 forming a mounting hole 243. A coupler 52 in the form of screw is engaged in mounting hole 243, and extends from heat sink 20 to terminate in a coupler-head 521. Housing 12 has a slotted cavity 54 which extends along, and is integrally formed with, each of border structures 40 and forms the interlock by receiving and engaging coupler-heads 521 therein.

Figure 2:
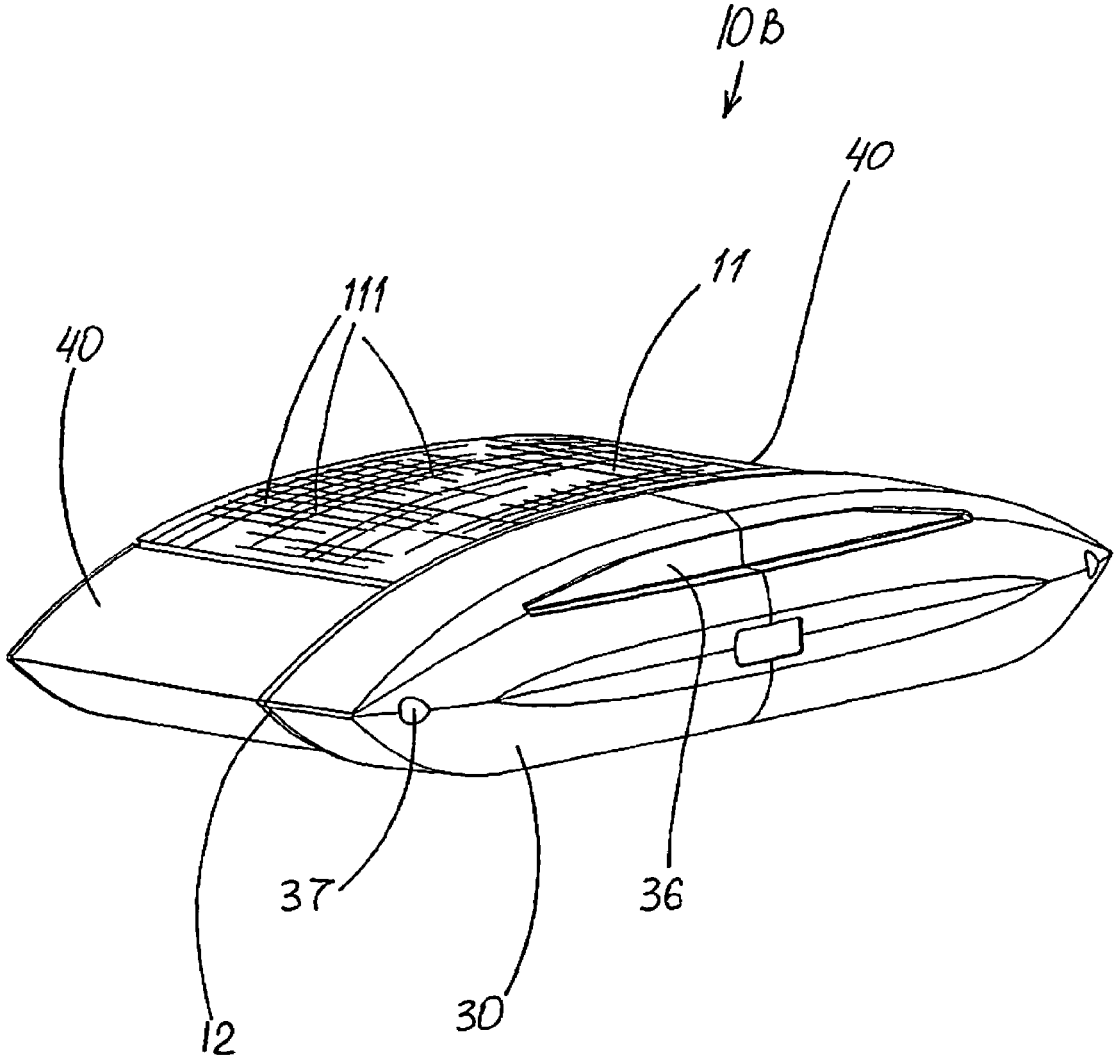
FIG. 2 is a perspective view of the LED floodlight fixture configured for wall mounting.

FIG. 2 illustrates a version of the invention which is LED floodlight fixture 10B. In floodlight fixture 10B, perimetrical structure 12 includes a pair of nose structures 40 configured for wall mounting and one frame structure 30 in substantially perpendicular relationship to each of the two nose structures 40.

The substantially rectangular floodlight fixture 10A which is best illustrated in FIGS. 1, 3 and 4, perimetrical structure 12 includes a pair of opposed frame structures 30 and a pair of opposed first nose structure 40 and second nose structure 41. The second nose structure 41 has two spaced sub-portions 41A and 41B with a gap 412 therebetween. Sub-portions 41A and 41B each include all of the nose-portion elements. Gap 412 accommodates a pole-mounting assembly 60, one embodiment of which is shown in FIGS. 1, 3, 4 and 12, that is secured to LED assembly 18 between nose sub-portions 41A and 41B.

Pole-mounting assembly 60 includes a pole-attachment portion 61 that receives and secures a pole 15 and a substantially water/air-tight section 62 that encloses electrical connections and has wire-apertures 64. Each wire-aperture 64 communicates with nose-portion 42 chamber of a respective one of nose-structure sub-portions 41A and 41B. Nose-structure sub-portions 41A and 41B are in water/air-tight engagement with water/air-tight section 62 of pole-mounting assembly 60. Water/air-tight section 62 includes grooves 621 on its opposite sides 622; grooves 621 are configured for mating engagement with end edges 413 of nose-structure sub-portions 41A and 41B.

Figure 12:
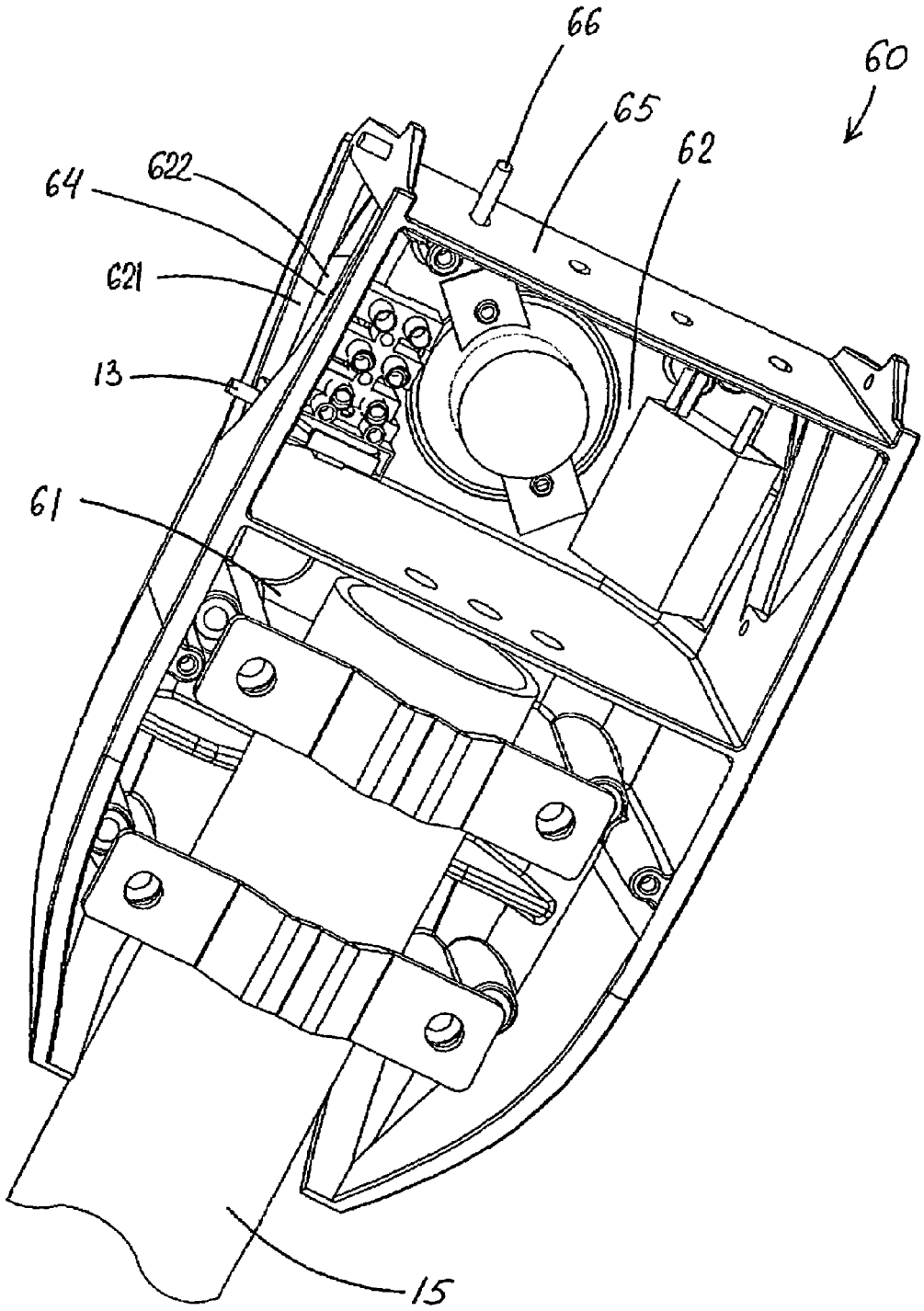
FIG. 12 is an enlarged fragmentary perspective view from below of the pole-mounting assembly engaged with a pole-attachment portion, with the cover of the pole-mounting assembly removed to show internal parts.

As best seen in FIG. 12, pole-mounting assembly 60 has a mounting plate 65 abutting LED assembly 18, and fastener/couplers 66 extend from mounting plate 65 into engagement with mounting hole 243 of middle-fins 241.

Figure 9:
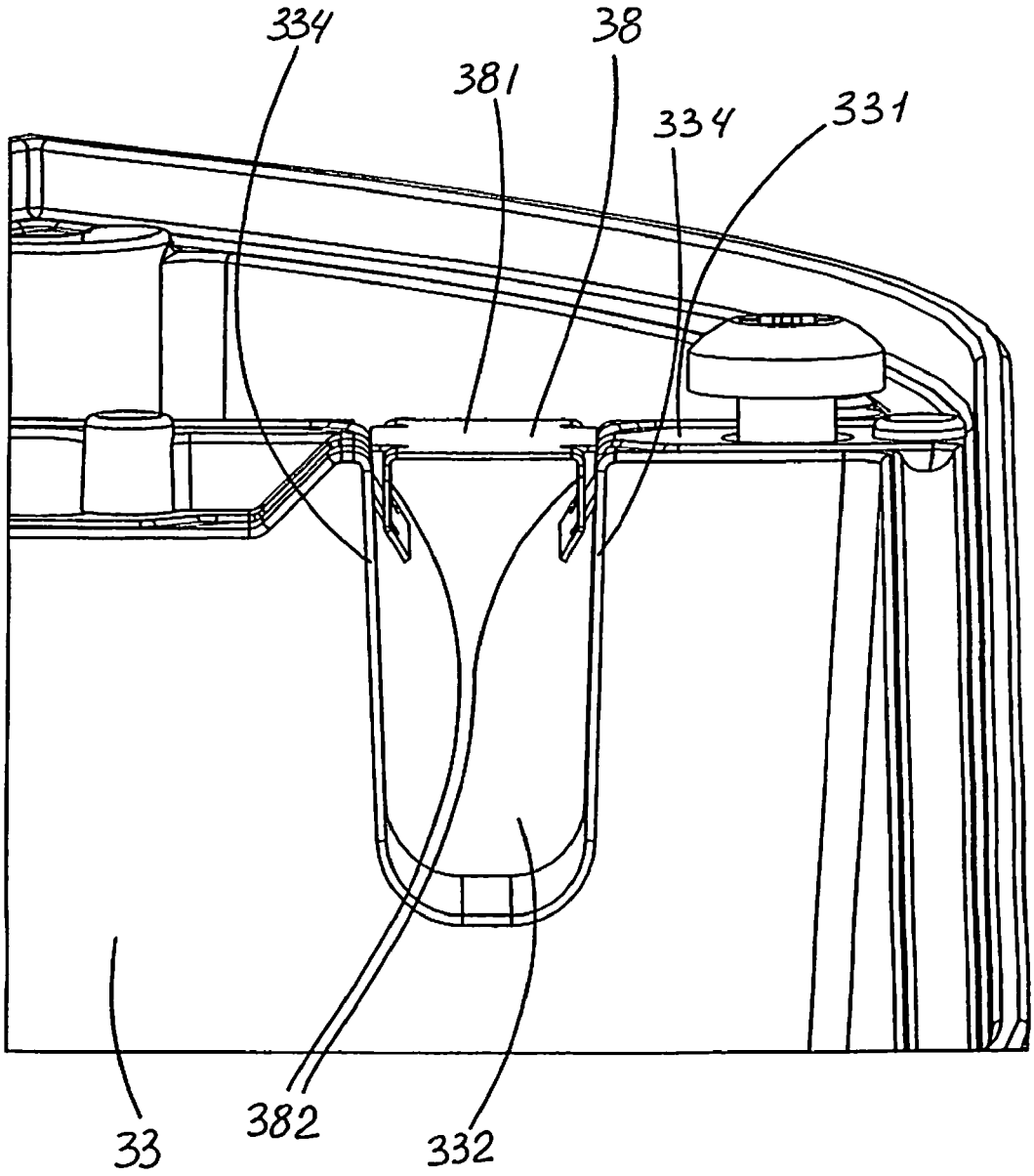
FIG. 9 is a greatly enlarged fragmentary perspective view showing a portion of the chamber-divider wall, the notch therein and the notch-bridge thereover.

FIGS. 8 and 9 show that frame-portion 32 of chamber 14 has a chamber-divider 33 across chamber 32 that divides frame-portion 32 of chamber 14 into an end part 321 and a main part 322, which encloses electronic LED driver(s) 16. Chamber-divider 33 has a divider-edge 331. Chamber-divider 33 includes a substantially water/air-tight wire-passage therethrough in the form of a notch 332 having spaced notch-wall ends 334 that terminate at divider-edge 331. A notch-bridge 38 spans notch 332 to maintain the water/air-tight condition of chamber 32. Notch-bridge 38 includes a bridge-portion 381 and a pair of gripping-portions 382 which are configured for spring-grip attachment to notch-wall ends 334. A removable cover-plate 31 seals main part 322 of frame-portion 32 of chamber 14 in substantially water/air-tight condition.

FIGS. 2-6 show that inventive LED floodlight fixtures 10 include a protective cover 11 that extends over LED assembly 18 and is secured with respect to housing 12. Protective cover 11 has perforations 111 to permit air and water flow therethrough for access to and from LED assembly 18.

As best seen in FIGS. 5 and 6, LED floodlight fixture 10 has a venting gap 56 between housing 12 and LED assembly 18, to permit air and water flow from heat sink 20. Venting gap 56 is formed by the interlock of housing 12 to LED assembly 18 or is a space along outer side-fins of the LED assembly.

Figure 13:
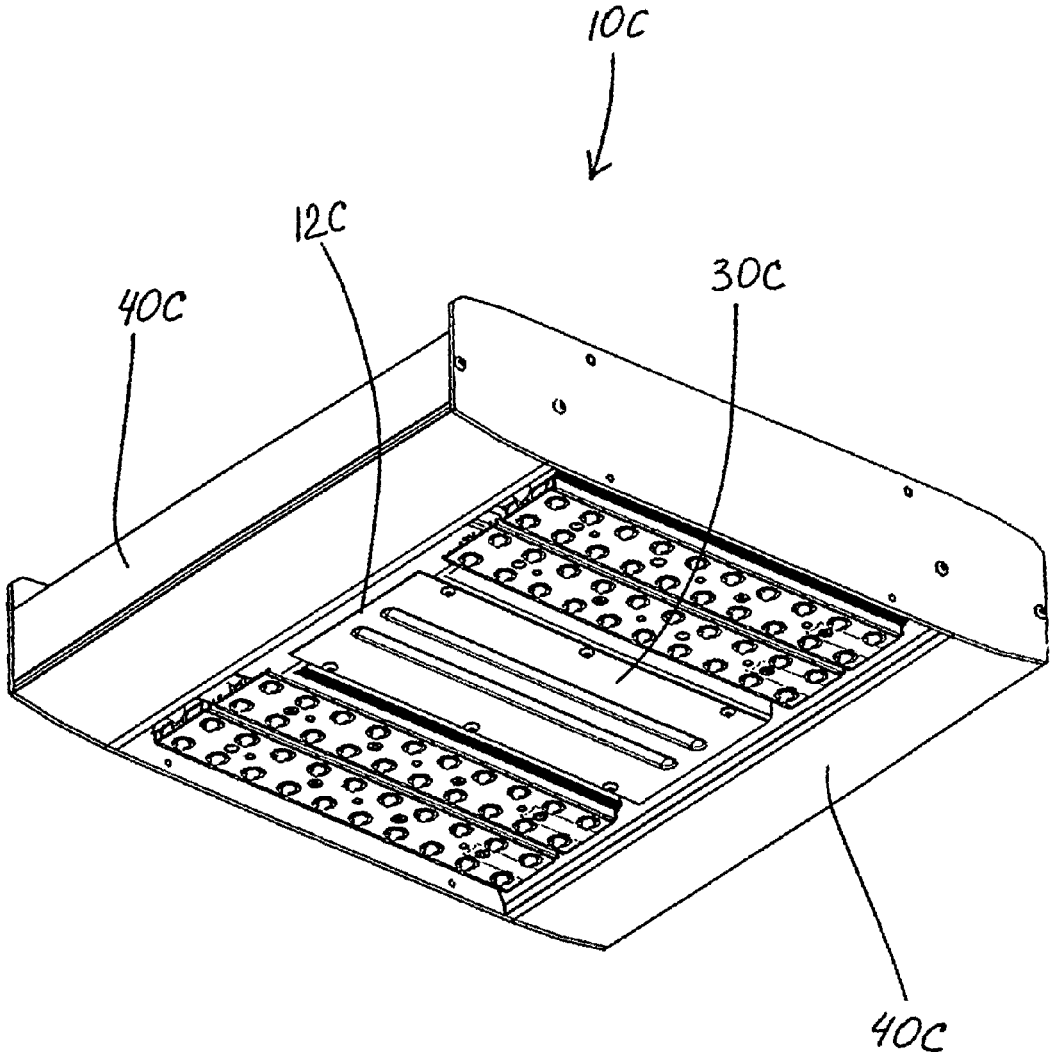
FIG. 13 is a perspective view of the LED floodlight fixture of the type having the housing being a substantially H-shaped structure.

FIG. 13 shows an embodiment of the inventive floodlight fixture 10C in which frame structure 30C is a sole frame structure, and housing 12C is a substantially H-shaped structure with sole frame structure 30C secured between mid-length positions of the pair of opposed border structures 40C.

Figure 14:
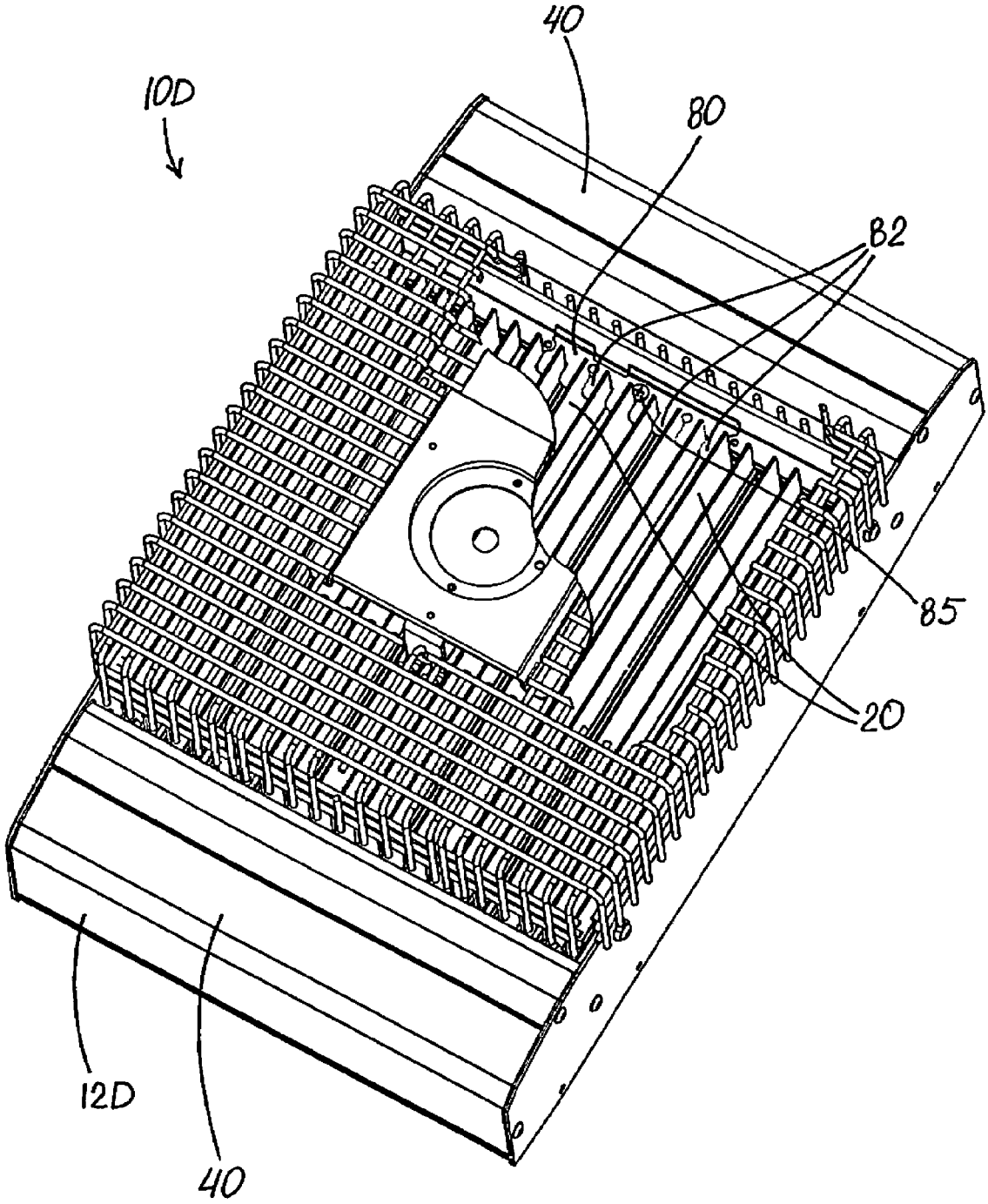
FIG. 14 is a top perspective view of another embodiment of the LED floodlight fixture including a restraining bracket seen through a cut-away in the protective cover.
Figure 15:
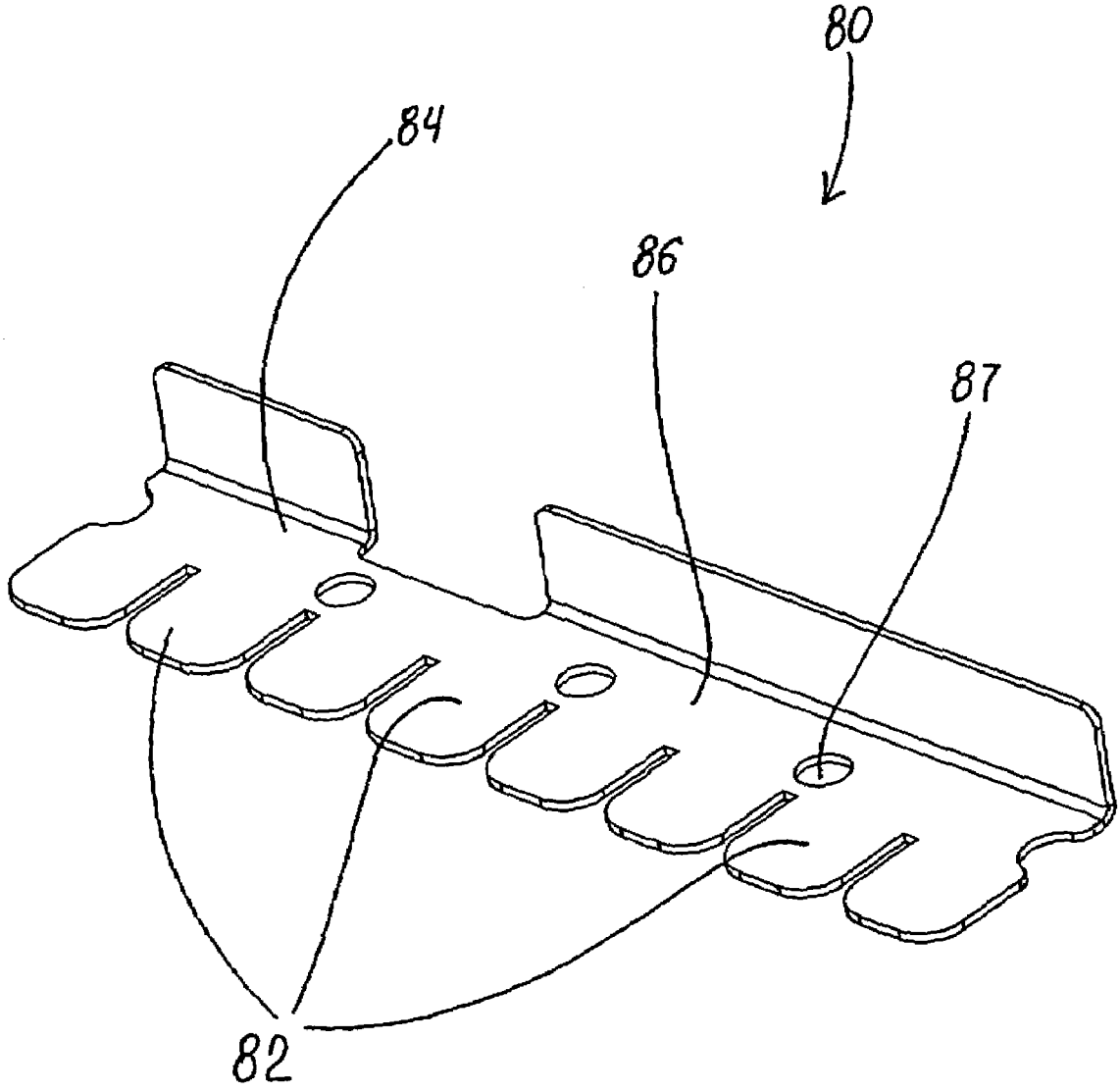
FIG. 15 is a perspective view of the restraining bracket of FIG. 14.

FIG. 14 shows another embodiment of the inventive LED floodlight fixture 10D with housing 12D formed by a pair of opposed border structures 40 and LED assembly 18 secured between border structures 40. Floodlight fixture 10D, as shown on FIG. 14, includes a restraining-bracket 80 secured to housing 12D by screws 85 through screw-holes 87. Bracket 80 has a plurality of projections 82 each of which extends between adjacent fins of two of heat sinks 20. Restraining bracket 80, best shown on FIG. 15, is a comb-like structure with an elongated body 84 including a spine-portion 86 from which the plurality of projections 82 extend. Restraining-bracket 80 is configured and dimensioned for elongated body 84 to be fixedly secured to housing 12 and for projections 82 to snugly fit in spaces between adjacent heat-sink fins.

While the principles of the invention have been shown and described in connection with specific embodiments, it is to be understood that such embodiments are by way of example and are not limiting.

The invention claimed is:

1. An LED lighting fixture comprising:

a housing forming a substantially water/air-tight chamber and including first and second border structures forming first and second border-portions of the chamber;

at least one electronic LED driver enclosed within the chamber; and an LED assembly outside the chamber to permit air/water-flow over the LED assembly which includes (a) at least one LED-array module mounted on (b) an elongate extruded LED heat sink that extends along a side of the housing and has a base with an LED-engaging surface and an opposite heat-transfer surface extending between two heat-sink ends with one end being interlocked with the first border structure and the other end being interlocked with the second border structure, the first border structure receiving wires from the LED-array module; and an interlock of the side of the housing with at least one of the heat-sink ends to secure the LED assembly to the housing, the interlock forming a venting gap between the heat-sink end and the housing to permit air/water-flow over the LED assembly.

2. An LED lighting fixture comprising:

a housing forming a substantially closed chamber and including a first and second border structures, the first border structure having a first border-portion of the chamber;

an LED assembly outside the chamber to permit air/water-flow over the LED assembly which includes at least one LED-array module mounted on an elongate extruded LED heat sink that extends along the housing and has a base with an LED-engaging surface and an opposite heat-transfer surface extending between two heat-sink ends, with the heat sink being secured with one end at the first border structure and the other end at the second border structure, the LED-array module being electrically connected at the first border structure.

3. The LED lighting fixture of claim 2 wherein the LED assembly includes a plurality of LED modules separately mounted on individual interconnected heat sinks, each heat sink further having:

a female side-fin and a male side-fin, one along each of two opposite sides of the base and each protruding from the opposite heat-transfer surface to terminate at a distal fin-edge, the female side-fin including a flange hook positioned to engage the distal fin-edge of the male side-fin of an adjacent heat sink; and at least one inner-fin protruding from the opposite surface between the side-fins.

4. The LED lighting fixture of claim 2 wherein:

the heat sink has fins protruding from the opposite heat-transfer surface; and a restraining bracket is secured to the housing and having a plurality of projections extending between adjacent pairs of fins of the heat sink, thereby to secure the LED assembly.

5. The LED lighting fixture of claim 2 wherein the housing includes substantially water/air-tight wire-access(s) receiving wires from the LED assembly into the chamber.

6. The LED lighting fixture of claim 2 further comprising a mounting assembly secured to the housing, the mounting assembly includes:

a pole-attachment portion; and a substantially water/air-tight section enclosing electrical connections and having at least one wire-aperture communicating with the water/air-tight chamber, the housing being in water/air-tight engagement with the water/air-tight section of the pole-mounting assembly.

7. The LED lighting fixture of claim 2 further including a protective cover extending over the LED assembly and secured with respect to the housing, the protective cover having perforations permitting flow therethrough.

8. The LED lighting fixture of claim 2 wherein the housing further includes a frame structure forming a frame-portion of the chamber and secured to the first border structure, the frame structure extending along the LED assembly.

9. The LED lighting fixture of claim 2 wherein the housing further includes a frame structure secured to the first and second border structures.

10. The LED lighting fixture of claim 9 wherein the housing is a perimetrical structure configured for wall mounting and includes the first and second border structures on opposed perimetrical sides and the frame structure secured on a perimetrical side between the border structures.

11. The LED lighting fixture of claim 9 wherein the housing is a perimetrical structure and the closed chamber substantially surrounds the LED assembly.

12. The LED lighting fixture of claim 11 wherein the perimetrical structure is substantially rectangular and includes the first and second border structures and a pair of opposed frame structures each secured to the first and second border structures.

13. The LED lighting fixture of claim 2 further including an interlock of a side of the housing with at least one of the heat-sink ends to secure the LED assembly to the housing, the interlock forming a venting gap between the heat-sink end and the housing to permit air/water-flow over the LED assembly and having:

a slotted cavity extending along the side of the housing; and a cavity-engaging coupler which extends from the heat sink of the LED assembly and is received within the slotted cavity.

14. The LED lighting fixture of claim 2 wherein the chamber is substantially water/air-tight.

15. The LED lighting fixture of claim 2 including at least one electronic driver within the chamber.

16. The LED lighting fixture of claim 15 wherein the chamber is substantially water/air-tight.

17. An LED lighting fixture comprising:

a housing forming a substantially water/air-tight chamber and including first and second border structures forming first and second border-portions of the chamber;

at least one electronic LED driver enclosed within the chamber; and an LED assembly outside the chamber to permit air/water-flow over the LED assembly which includes (a) at least one LED-array module mounted on (b) an elongate extruded LED heat sink that extends along a side of the housing and has a base with an LED-engaging surface and an opposite heat-transfer surface extending between two heat-sink ends, with the heat sink being secured with one end at the first border structure and the other end at the second border structure, the LED-array module being electrically connected at the first border structure.

18. An LED lighting fixture comprising a housing and an LED assembly secured with respect to the housing to permit air/water-flow over the LED assembly which includes a plurality of LED-array modules separately mounted on individual interconnected elongate extruded heat sinks that extend along the housing, each heat sink having:

a base with an LED-engaging surface and an opposite heat-transfer surface extending between two heat-sink ends, a female side-fin and a male side-fin, one along each of two opposite sides of the base and each protruding from the heat-transfer surface to terminate at a distal fin-edge, the female side-fin including a flange hook positioned to engage the distal fin-edge of the male side-fin of an adjacent heat sink; and at least one inner-fin protruding from the opposite surface between the side-fins.

19. The LED lighting fixture of claim 18 including an interlock of the housing with at least one of the heat-sink ends to secure the LED assembly to the housing, the interlock forming a venting gap between the heat-sink end and the housing to permit air/water-flow over the LED assembly.

20. An LED lighting fixture comprising:

a housing including a first and second border structures;

an LED assembly secured with respect to the housing to permit air/water-flow over the LED assembly which includes at least one LED-array module mounted on an elongate extruded LED heat sink that extends along the housing and has a base with an LED-engaging surface and an opposite heat-transfer surface extending between two heat-sink ends, with the heat sink being secured with one end at the first border structure and the other end at the second border structure; and the heat-sink end and adjacent border structure define an air gap therebetween.

21. The LED lighting fixture of claim 20 wherein the LED-array module being electrically connected at the first border structure.

22. The LED lighting fixture of claim 21 wherein the housing forms a substantially closed chamber.

23. The LED lighting fixture of claim 22 including at least one electronic driver within the chamber.

24. The LED lighting fixture of claim 23 wherein the chamber is substantially water/air-tight.

* * * * *

UNITED STATES PATENT AND TRADEMARK OFFICE

CERTIFICATE OF CORRECTION

PATENT NO. : 7,686,469 B2
APPLICATION NO. : 11/860887
DATED : March 30, 2010
INVENTOR(S) : Ruud et al.

It is certified that error appears in the above-identified patent and that said Letters Patent is hereby corrected as shown below:

In column 5, line 60, delete "illustrates" and insert --illustrate--.

In column 7, line 47, after the word "of" insert --a--.

In column 9, line 26, delete "a".

In column 11, line 15, delete "a".

Signed and Sealed this

Twenty-seventh Day of April, 2010

David J. Kappos

David J. Kappos
*Director of the United States Patent and Trademark Office*